United States Patent [19]

Walker et al.

[11] Patent Number: 4,621,396

[45] Date of Patent: Nov. 11, 1986

[54] MANUFACTURING OF SHAPED CHARGE CARRIERS

[75] Inventors: Jerry L. Walker, Fort Worth; Donald L. Crummett, Joshua, both of Tex.; William C. Behling, Duncan, Okla.

[73] Assignees: Jet Research Center, Inc., Arlington, Tex.; Halliburton Company, Duncan, Okla.

[21] Appl. No.: 749,954

[22] Filed: Jun. 26, 1985

[51] Int. Cl.[4] ..... B21D 51/54; B23D 21/14; E21B 7/00

[52] U.S. Cl. ..... 29/1.3; 83/180; 83/188; 175/4.6

[58] Field of Search ..... 72/324, 334, 370, 398; 83/180, 193, 188; 29/1.3; 175/4.6

[56] References Cited

U.S. PATENT DOCUMENTS

| | | | |
|---|---|---|---|
| 168,176 | 9/1875 | Olmsted | 83/180 |
| 252,247 | 1/1882 | Olmsted | 83/180 |
| 1,432,073 | 10/1922 | Lowy | 83/191 |
| 2,686,472 | 8/1954 | Burns . | |
| 2,749,841 | 6/1956 | Jones . | |
| 2,750,884 | 6/1956 | Gaines . | |
| 2,764,938 | 10/1956 | Harcus . | |
| 2,884,066 | 4/1959 | Teplitz et al. | 83/180 |
| 3,489,045 | 1/1970 | Ray | 83/188 |
| 3,589,453 | 6/1971 | Venghiattis . | |
| 3,698,274 | 10/1972 | Coulon et al. | 83/188 |
| 3,773,119 | 11/1973 | Shore . | |
| 4,479,556 | 10/1984 | Stout et al. . | |

OTHER PUBLICATIONS

The structure illustrated in FIGS. 1–7 and 13 of U.S. patent application Ser. No. 651,201 filed Sep. 17, 1984, entitled Shaped Charge Carrier Assembly, assigned to the assignee of the present invention. The application itself is not prior art.

*Primary Examiner*—Howard N. Goldberg
*Assistant Examiner*—Steven Nichols
*Attorney, Agent, or Firm*—Joseph A. Walkowski

[57] ABSTRACT

Methods are provided for manufacturing a shaped charge carrier from a generally cylindrical thin wall tube. A plurality of flat areas are formed on the cylindrical tube, and an opening through the tube is associated with each of the flat areas for receiving a shaped charge therein.

17 Claims, 15 Drawing Figures

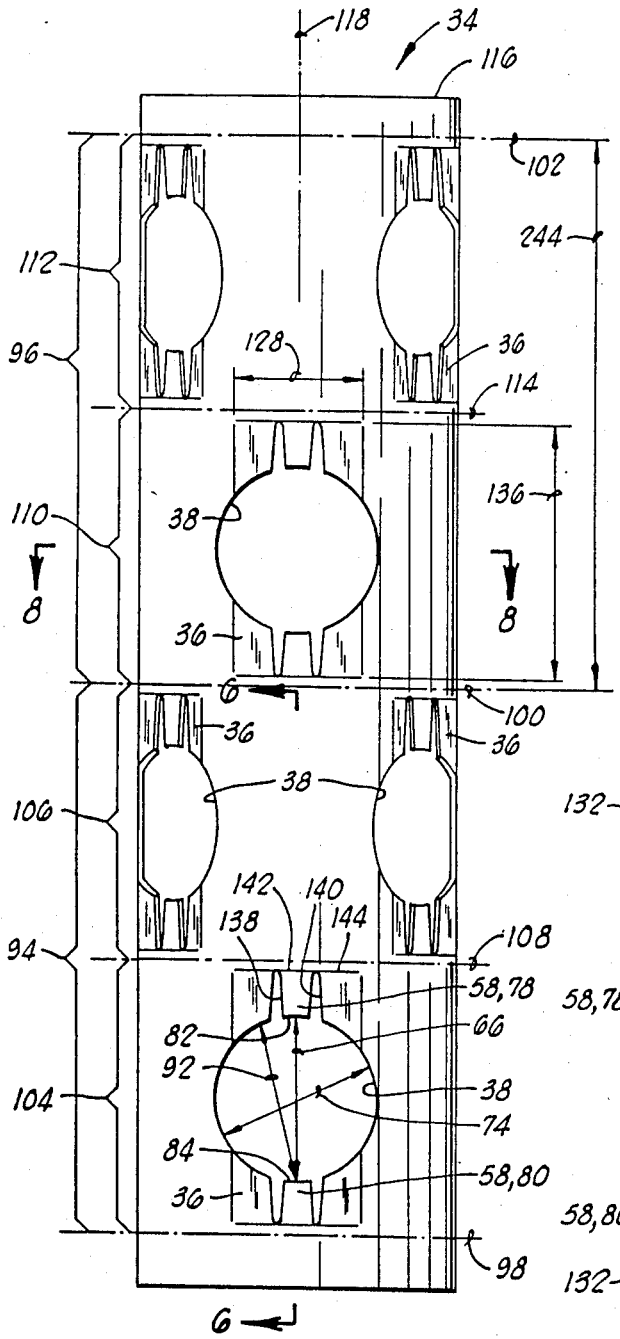
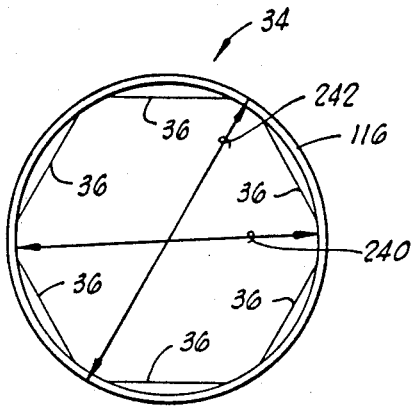
FIG. 7
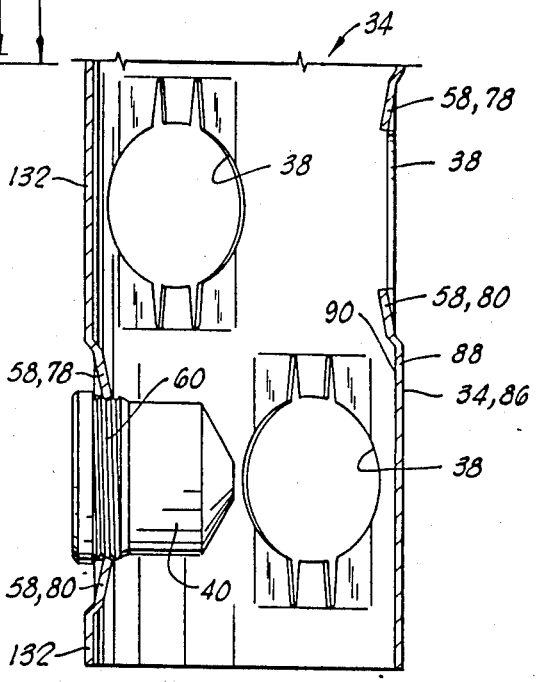
FIG. 5
FIG. 6

MANUFACTURING OF SHAPED CHARGE CARRIERS

BACKGROUND OF THE INVENTION

1. Field of the Invention

The invention relates to elongated perforating guns of the type generally used to perforate oil and gas wells, and particularly relates to methods of manufacturing a shaped charge carrier for such a perforating gun.

2. Description of the Prior Art

Perforating guns commonly used in wireline service operations for perforating an oil or gas well typically include an elongated cylindrical outer housing within which is received an elongated carrier which has a number of shaped charges in place in the carrier. The carrier is located relative to the housing so as to locate each of the shaped charges adjacent reduced thickness portions of the housing.

It is well known in the prior art to utilize either triangular or hexagonal cross-section tubular carriers constructed to receive three 120° circumferentially spaced shaped charges in a given horizontal plane. When a hexagonal carrier is utilized, longitudinally adjacent layers of charges may be rotated 60° relative to each other to spread out the pattern of perforations along the length of the well which is to be perforated.

Until relatively recently, the shaped charges have been held in place relative to the carrier by snap rings which interlock both with the outer case of the shaped charge and with the carrier, and by other separate attachment devices.

Recently the assignee of the present invention has developed an improved shaped charge carrier made of sheet metal which has openings formed therein along with resilient tab means adjacent those openings. The shaped charges may be assembled with the carrier by merely pressing them into the openings. The resilient tab means forcibly grip the shaped charges and hold them in place within the carrier.

This prior art device is shown and described in detail in U.S. patent application Ser. No. 651,201 filed Sept. 17, 1984, for SHAPED CHARGE CARRIER ASSEMBLY, which is assigned to the assignee of the present invention. The structure shown in FIGS. 1–7 and 13 of application Ser. No. 651,201 is a part of the prior art. That device utilizes a hexagonal cross-section tubular carrier for receiving the various shaped charges. It is noted that application Ser. No. 651,201 itself is not a part of the prior art. Applicants are merely referring to FIGS. 1–7 and 13 of that prior application as a convenient means of describing the structure shown in those figures, which structure is a part of the prior art. Any disclosure of application Serial No. 651,201 which is not illustrated in FIGS. 1–7 and 13 is not conceded to be part of the prior art.

As is apparent from application Ser. No. 651,201, and particularly from FIG. 5 thereof, the construction of the hexagonal cross-section carrier is a rather complicated task, since that carrier is assembled from three sheet metal sections, each of which requires extensive forming work to manufacture. Additionally, substantial time and expense is involved in assembling the sheet metal sections to form the hexagonal cross-section carrier.

SUMMARY OF THE INVENTION

The present invention provides methods for manufacturing an improved carrier utilizing openings and tab means similar to those disclosed in the above-referenced application Ser. No. 651,201, but providing a very much simplified design for the carrier itself.

The shaped charge carrier apparatus manufactured by the methods of the present invention includes a generally cylindrical thin wall carrier tube. A plurality of flat areas are formed on the generally cylindrical carrier tube, and an opening with associated tab means is formed in each of the flat areas.

Thus, a one-piece construction is provided for the carrier tube, thus eliminating many of the metal forming, and assembly steps necessary to manufacture the hexagonal cross-section carrier described in the above-referenced application Ser. No. 651,201.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 5 is an elevation view of an upper portion of the carrier tube of the apparatus of FIG. 1.

FIG. 6 is a sectioned elevation view of a lower part of the carrier tube of FIG. 5, taken along line 6—6 of FIG. 5.

FIG. 7 is a top end view of the carrier tube of FIG. 5.

DETAILED DESCRIPTION OF THE INVENTION

Figure 1:
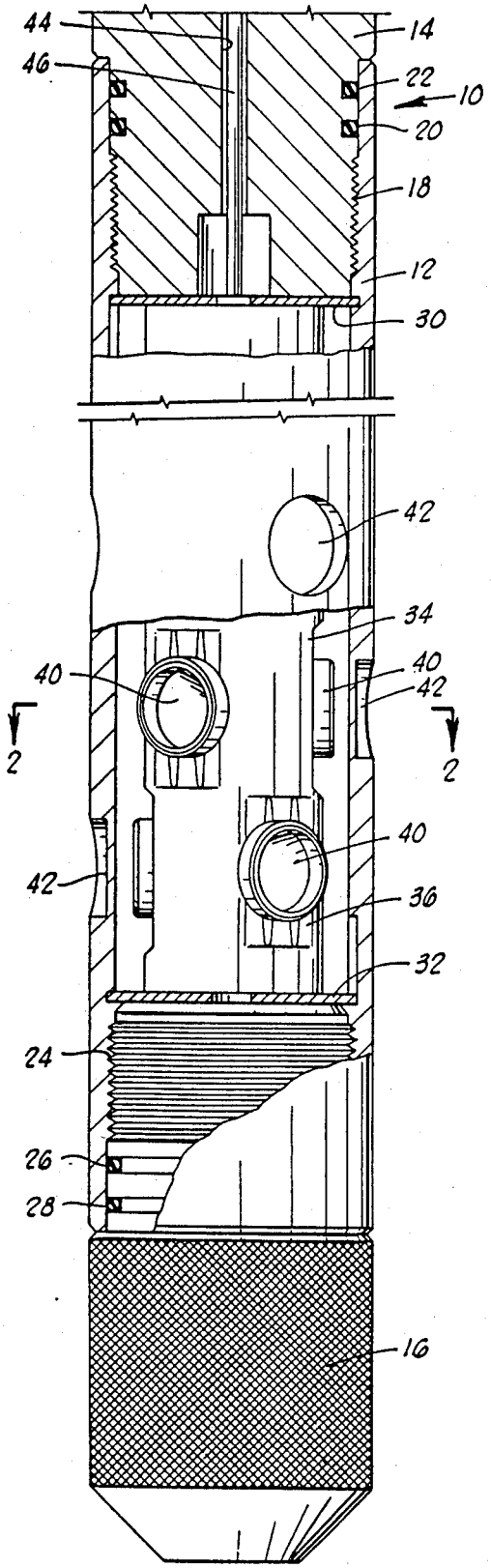
FIG. 1 is an elevation, partly sectioned view of a perforating gun showing a generally cylindrical carrier tube in place within the perforating gun, with a plurality of shaped charges in place within the carrier tube.
Figure 2:
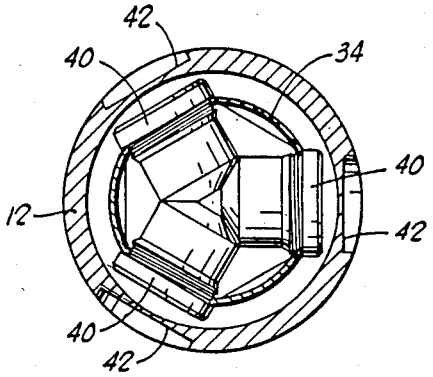
FIG. 2 is a sectioned view taken along line 2—2 of FIG. 1 showing a layer of three 120° circumferentially spaced shaped charges in place within the generally cylindrical carrier tube of FIG. 1.

Referring now to the drawings, and particularly to FIG. 1, a perforating gun is thereshown and generally designated by the numeral 10. The perforating gun 10 includes an elongated cylindrical outer housing 12, the upper end of which is closed by a top plug 14 and the lower end of which is closed by a bottom plug 16. Top plug 14 is threadably connected to housing 12 at threaded connection 18 and a seal is provided therebetween by the O-rings 20 and 22. The bottom plug is threadedly connected to housing 12 at threaded connection 24 and a resilient seal is provided therebetween by O-rings 26 and 28.

In place within the housing 12 adjacent the lower end of top plug 14 and the upper end of bottom plug 16 are upper and lower carrier mounting plates 30 and 32, respectively.

Held in place between the upper and lower mounting plates 30 and 32 is an elongated, generally cylindrical thin wall charge carrier tube 34. For example, a 3.5-inch outside diameter carrier tube 34 can be satisfactorily formed from 16 Gauge AISI 1018 tubing having a wall thickness of 0.065 inch.

The carrier tube 34 has a plurality of flat areas 36 defined thereon. Each of the flat areas 36 has an opening 38 (see FIG. 5) disposed therethrough for receiving a shaped charge 40 therein.

The carrier tube 34 is attached to the end plates 30 and 32 in such a manner as to specifically define its angular orientation about its longitudinal axis 118 (see FIG. 5) relative to the housing 12, so that each of the shaped charges 40 is located immediately adjacent a reduced thickness portion 42 of the housing 12.

Disposed through a central opening 44 of top plug 14 is a firing means 46 which generally comprises a length of prima cord and associated apparatus for firing the shaped charges 40 in response to an electrical signal directed down a wireline (not shown) from a surface location at the top of the oil or gas well which is being perforated. As will be understood by those skilled in the art, the firing means 46 extends downward through the carrier tube 34 and is operatively connected to each of the shaped charges 40.

Figure 3:
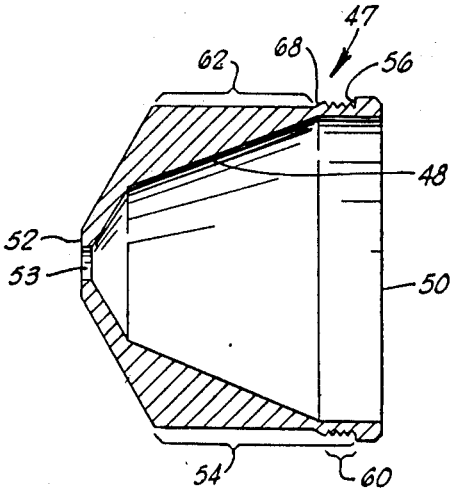
FIG. 3 is a cross-section view taken along a length of an outer case of one of the shaped charges shown in FIG. 2.
Figure 4:
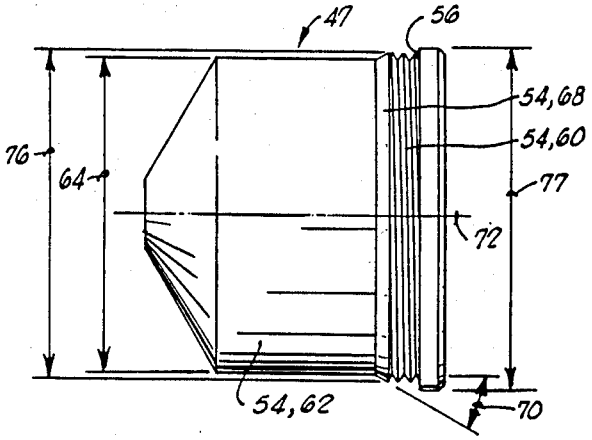
FIG. 4 is a side elevation view of the outer case of the shaped charge shown in FIG. 3.

The manner of construction of the shaped charges 40 is shown in FIGS. 3 and 4. FIG. 3 is a cross-section view solely of an outer case 47 of the shaped charge 40. As will be understood by those skilled in the art, the interior 48 of the case 47 will contain appropriate explosives and liners.

The case 47 has a forward end 50 and a rearward end 52. An opening 53 is disposed through rear end 52 to permit the connection of the firing means 46 to the explosive contained in the case 47. Case 47 includes a generally cylindrical-shaped outer surface 54 and a rearwardly facing first shoulder 56 extending radially outward from the outer surface 54.

As is best seen in FIG. 5, each of the openings 38 disposed through the wall of carrier tube 34 is generally circular in shape and as illustrated in FIG. 6 is large enough to receive the outer surface 54 of the case 47 therethrough.

The carrier also includes resilient tab means 58 corresponding to each opening 38, which tab means extend into the opening 38 for frictionally engaging at least a first portion 60 of outer surface 54 of the case 47 and for thereby holding the shaped charge 40 in place relative to the carrier tube 34 with the first shoulder 56 of the shaped charge 40 abutting the carrier tube 34 as best illustrated in FIG. 6.

Preferably, the first portion 60 of cylindrical outer surface 54 is a grooved first portion 60 having a plurality of longitudinally spaced circumscribing grooves as best seen in FIGS. 3 and 4. Although the grooves of first portion 60 of outer surface 54 may be formed in any number of ways, a preferable manner of forming the grooves is by machining a spiral threadlike surface on first portion 60 as best illustrated in FIG. 4.

The tab means 58 of carrier tube 34 engages the grooves of grooved first portion 60 of outer surface 54 of case 47 when the shaped charge 40 is in place with the shoulder 56 abutting the carrier tube 34.

The outer surface 54 of case 47 further includes a reduced diameter portion 62 located rearward of the grooved first portion 60. The reduced diameter portion 62 has an outside diameter 64 less than an internal diameter 66 (see FIG. 5) of opening 38 of carrier tube 34 at the tab means 58, so that the reduced diameter portion 62 of the outer surface 54 of the case 47 may freely pass through the opening 38.

The cylindrical outer surface 54 of case 47 further includes a tapered portion 68 located between the reduced diameter portion 62 and the grooved first portion 60. Preferably, the tapered portion 68 slopes at an angle 70 of about 15° from a central axis 72 of the case 47.

The generally circular opening 38 has an inside diameter 74 (see FIG. 5) which is greater than the outside diameter 64 (see FIG. 4) of reduced diameter portion 62 and which is also greater than the outside diameter 76 (see FIG. 4) of grooved first portion 60 of outer surface 54.

The first shoulder 56 of case 47 is annular in shape and has an outside diameter 77 (see FIG. 4) greater than the inside diameter 74 (see FIG. 5) of opening 38 so that the shoulder 56 cannot fit through the opening 38.

As illustrated in FIG. 5, the resilient tab means 58 of the carrier 34 preferably includes two diametrically opposed tabs 78 and 80 located on opposite sides of opening 38, said tabs 78 and 80 extending into the opening 38 toward each other. Preferably, the opposed tabs 78 and 80 lie along a line substantially parallel to longitudinal axis 118 of carrier tube 34.

The internal diameter 66 of the opening 38 at the tab means 58, which may also be defined as the diametrical distance between radially innermost ends 82 and 84 of tabs 78 and 80, is less than the inside diameter 74 of the generally circular portion of opening 38, and is also less than the outside diameter 76 of first portion 60 of cylindrical outer surface 54 of case 47.

Thus, the dimensional relationships just defined for the case 47 and the opening 38 provide a carrier tube 34 and outer case 47 of shaped charge 40 which are so arranged and constructed that when the cylindrical outer surface 54 of case 47 is inserted in a rearward direction through the opening 38 of carrier tube 34 until the shoulder 56 abuts the carrier tube 34, the tabs 78 and 80 of resilient tab means 58 frictionally engage the first portion 60 of outer surface 54 and are deflected rearwardly from an initial position of the tabs. The reduced diameter surface 62 is freely received between tabs 78 and 80. The tapered surface 68 engages the tabs 78 and 80 and deflects them before they engage the first portion 60 of outer surface 54.

This is best understood by viewing FIG. 6 which is a sectional view taken along line 6—6 of FIG. 5. In the upper right corner of FIG. 6, one of the openings 38 is shown in cross section without a shaped charge in place therein, thus illustrating the initial position of tabs 78 and 80 of resilient tab means 58 prior to insertion of the shaped charge 40 in the opening 38. In FIG. 6, the numeral 86 designates the outer surface of the wall 88 of carrier tube 34, and the numeral 90 designates the inner surface of wall 88. As shown in the upper right corner of FIG. 6, the tabs 78 and 80 are preferably initially deformed to a slightly rearward position out of the plane of wall 88 so as to promote the ease of insertion of the shaped charge 40 therebetween.

The tabs 78 and 80 are so dimensioned and constructed that when they are deflected from their initial position shown in the upper right corner of FIG. 6 to the position shown in the lower left corner of FIG. 6, they are resiliently deformed, and while they are so deflected the tabs 78 and 80 continuously exert opposed lateral forces against the threaded first portion 60 of outer surface 54 of case 47 so as to tightly hold the case 47 in place relative to the carrier tube 34. In the illustrated embodiment, this resilient deformation is partially elastic. Although the tabs are to some extent permanently deformed during the insertion of the case 47, the tabs still press against the sides of case 47.

The appropriate dimensions and shape of the tabs will, of course, depend upon the particular material utilized, the number of tabs utilized, the shape and size of the outer surface of the shaped charge, and the desired insertion force.

Preferably, the tab means 58 is constructed so that the shaped charges 40 may be inserted in the openings 38 by manually applied pressure against the outer forward end 50 of the shaped charge 40. The tab means 58 is preferably constructed to provide the maximum frictional holding force against the case 47, while still being flexible enough that the case 47 may be inserted manually.

Figure 15:
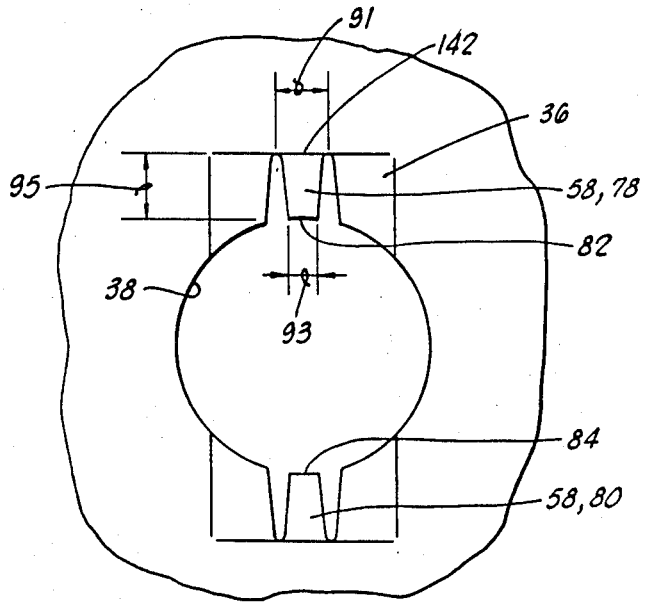
FIG. 15 is an enlarged view of one of the flat areas with its associated opening and tab means.

As is best seen in the enlarged view of FIG. 15, the construction of the tabs 78 and 80 has been improved as compared to the tabs of the structure illustrated in FIGS. 1–7 and 13 of prior U.S. patent application Ser. No. 651,201.

The tabs of that prior art structure are substantially rectangular having a root of substantially the same width as a free end thereof. It has been determined that such rectangular tabs sometimes do not have sufficient resiliency to hold the shaped charges in place when the perforating gun is subjected to sudden jarring.

The tabs of the present invention, however, have been modified to have a tapered or wedge shape. The tapered tabs 78 and 80 have a root 142 with a width 91 wider than a width 93 of free ends 82 and 84 thereof. This provides a more resilient tab, due to the broader root, than would be provided by a rectangular tab having a free end of the same width as the free ends 82 and 84 of tapered tabs 78 and 80.

For example, in a carrier tube 34 formed from a 3.5-inch outside diameter, 16 gauge, AISI 1018 tube having a wall thickness of 0.065 inch, it has been determined that a satisfactory tapered tab 78 has a root width 91 of approximately 0.375 inch, a free end width 93 of approximately 0.25 inch, and a length 95 of approximately 0.5 inch.

Thus, in the specific embodiment illustrated in FIG. 15, the tapered tab 78 has the root width 91 at least 1.5 times the width 93 of free end 82, and has the length 95 approximately twice the width 93 of free end 82.

Such a construction provides a more resilient tab than can be achieved with rectangular tabs, yet can still be formed from a thin wall tube.

The tab means 58 illustrated in FIG. 5 is designed so that if either one of the tabs 78 or 80 is damaged, i.e., bent out of shape so that it cannot engage the case 47, the remaining functional tab 78 or 80 will still hold the case 47 firmly in place relative to the carrier tube 34. This feature is accomplished as follows. A distance 92 (see FIG. 5) between the radially innermost end 84 of tab 80 and the inner edge of generally circular opening 38 immediately adjacent the other tab 78 is sufficiently less than the outside diameter 76 (see FIG. 4) of grooved first portion 60 of outer surface 54 of case 47 so that if either of the tabs 78 or 80 is deformed so that it cannot engage the case 47, the other of the tabs 78 or 80 will still frictionally engage the grooved first portion 60 of cylindrical outer surface 54 of case 47 to hold the shaped charge 40 in place relative to carrier tube 34 with the shoulder 56 of shaped charge 40 abutting the carrier tube 34.

As previously mentioned, each of the openings 38 is formed through one of the flat areas 36 defined on the carrier tube 34.

The flat areas 36 are arranged in a pattern such as shown in FIG. 5, which pattern comprises a plurality of repetitive pattern portions such as first pattern portion 94 and second pattern portion 96 (see FIG. 5), the ends of which are represented by imaginary lines 98, 100, and 102.

Each of the pattern portions such as 94 and 96 may generally be described as including at least two flat areas 36, and in the illustrated embodiment each pattern portion includes six flat areas 36.

In the preferred embodiment of FIG. 5, the flat areas of each of the pattern portions such as first pattern portion 94 are arranged in two longitudinally spaced sets such as first set 104 and second set 106. The dividing line between first and second sets 104 and 106 is represented by the imaginary line 108.

Similarly, second pattern portion 96 includes a first set 110 thereof, and a second set 112 thereof, the dividing line between which is represented by the imaginary line 114.

Each of the sets, such as 104, 106, 110 or 112, may generally be described as including at least two flat areas 36 located at a common longitudinal distance from an end such as upper end 116 of carrier tube 34.

As is apparent in FIG. 5, in this preferred embodiment, adjacent sets of flat areas 36 such as 104 and 106 are angularly offset relative to each other about longitudinal axis 118 of carrier tube 34 so that the flat areas of one set such as 104 are not longitudinally aligned with the flat areas 36 of an adjacent set such as 106.

Furthermore, alternate sets of flat areas such as sets 104 and 110 are substantially identically angularly oriented about central axis 118 of the carrier tube 34 so that the flat areas 36 of one set such as 104 are substantially longitudinally aligned with the flat areas of an alternate set such as 110. Similarly, the flat areas of set 106 are substantially longitudinally aligned with the flat areas of set 112, and this relationship holds throughout the length of carrier tube 34 in this preferred embodiment.

Figure 8:
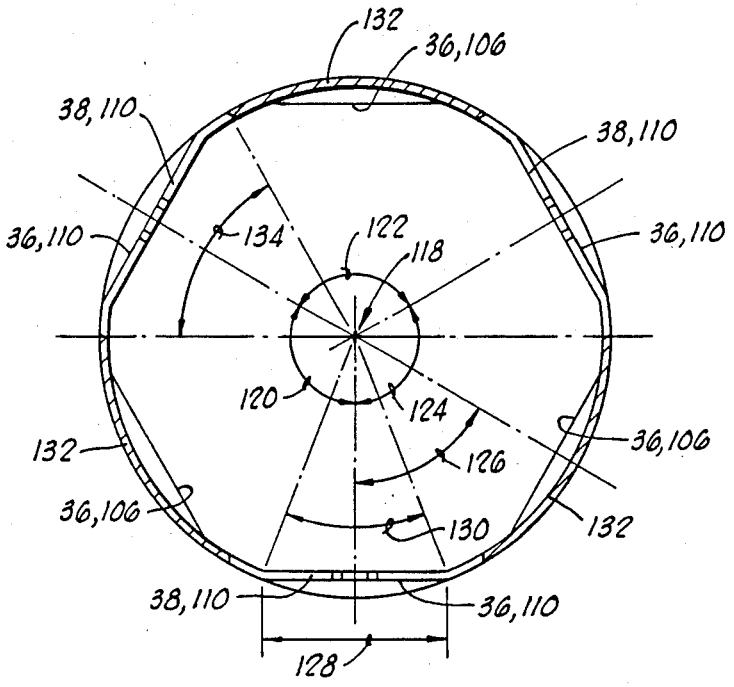
FIG. 8 is a plan sectioned view of the carrier tube taken along line 8—8 of FIG. 5.

Referring now to FIGS. 7 and 8, the angular relationship of the various flat areas 36 can readily be seen.

FIG. 7 is a top end view of carrier tube 34.

FIG. 8 is a plan sectioned view taken along line 8—8 of FIG. 5, showing the details of construction of the carrier tube 34. In FIG. 8, the flat areas 36 of first set 110 of second pattern portion 96 are shown in cross section and are indicated by the double designation 36,110.

Also visible below set 110 are the radially inner surfaces of the flat areas 36 of set 106 which are indicated by the double designation 36,106.

As is readily apparent from FIG. 8, each of the sets such as set 110 has its flat areas 36 substantially equally angularly spaced from each other at angles 120, 122 and 124 about central axis 118, each of which angles is equal to 120°.

Furthermore, as is apparent from FIG. 8, in the preferred embodiment each of the sets such as 110 and 106 includes an equal number of flat areas, namely three flat areas, and an angular offset such as represented by the angle 126 between adjacent sets such as 106 and 110 is equal to one-half the angular spacing such as 120 between the flat areas of a given set such as 110. Thus, the angle 126 in the preferred embodiment is equal to 60°.

Through this construction, the flat areas of one set such as 110 lie circumferentially equidistant between the flat areas of an adjacent set such as 106.

Although the preferred embodiment disclosed herein has the flat areas 36 arranged in pattern portions comprised of two sets of three flat areas each, the invention is not generally limited to such an embodiment.

First, it is not necessarily required that the flat areas be arranged in sets of equal numbers of equidistantly spaced flat areas. For example, the flat areas 36 could be placed in a spiral pattern or the like.

Furthermore, even when the flat areas 36 are arranged in sets of equal numbers of flat areas, each set does not necessarily include three flat areas. For example, a set could include two flat areas or four flat areas, for perhaps more.

Generally speaking, each of the sets such as set 110 can be described as including n flat areas, wherein is an integer greater than one. Further, the sets can be described in that each of the flat areas 36 is of substantially equal size having a width 128 perpendicular to longitudinal axis 118, said width defining an angle 130 about longitudinal axis 118 of no greater than (360/2n) degrees. In the example shown in FIG. 8, the angle 130 is less than 60°, since n equals three.

As is further apparent in FIG. 8, each of the flat areas such as flat areas 36,110, is circumferentially located between two substantially arcuate portions 132 of carrier tube 34.

Each of the openings 38,110 extends entirely across the width 128 of its associated flat area 36,110 and into each of the two arcuate portions 132 on either side of the flat area 36,110. Also, each flat area 36 is longitudinally located between two of the arcuate portions 132 as seen in FIG. 6.

Additionally, as is perhaps best apparent as seen in FIGS. 5 and 6, the openings 38 of adjacent sets overlap in a circumferential manner when viewed along the axis 118 of carried tube 34, so that each of the openings such as 38, 110 seen in cross section in FIG. 8 can generally be described as defining an angle 134 of greater than (360/2n) degrees.

Referring now to FIG. 5, it is there apparent that each of the flat areas 36 has a length 136 greater than the width 128 thereof.

As previously described, each of the flat areas 36 and openings 38 has a resilient tab means 58 associated therewith. That resilient tab means includes two diametrically opposed tabs 78 and 80 which are located on opposite sides of opening 38 and are aligned substantially parallel to longitudinal axis 118 of carrier tube 34.

As is best seen in FIG. 5, each of the tabs such as tab 78 is defined between two spaced slots such as 138 and 140, one on either side of the tab 78, said slots each having an open end joining their associated opening 38.

A root 142 of each of the tabs such as 78 is located substantially adjacent a longitudinal end such as 144 of its associated flat area 36, so that the length 136 of flat area 36 is substantially equal to a sum of the lengths, such as 95, of the tabs 78 and 80 parallel to axis 118 and the longitudinal distance 66 between the tabs 78 and 80 across their associated opening 36.

It is preferred that the tabs 78 and 80 be located entirely within their associated flat area 36. One reason for this is that during the punching operation wherein the hole 36 and associated tabs 78 and 80 are formed, the critical dimensions can be more closely maintained by forming most of the opening 38, and the entirety of the tabs 78 and 80 within the flat area 36. It would be possible for the length 136 of flat area 36 to be longer than illustrated in FIG. 5, but by making the length 136 equal to the lengths of the tabs 78 and 80 plus the distance 66 therebetween, the necessary length 136 of flat area 36 is minimized.

Although FIG. 5 illustrates a small longitudinal spacing between the upper ends of the flat areas 36 of one set, such as 104, and the lower ends of the flat areas 36 of an adjacent set, such as 106, it is not required that there be such a spacing. It is accpetable for the flat areas 36 of one set to slightly longitudinally overlap with the flat areas 36 of an adjacent set, and in such a situation the length of a pattern portion such as portion 96 would be defined as the distance between horizontal centerlines of alternating sets of openings 38 and thus the pattern portions themselves would slightly longitudinally overlap.

METHODS OF MANUFACTURING

Referring now to FIGS. 9–13, the general method of manufacturing a carrier tube such as carrier tube 34 will now be described.

As of the present time, we have not yet designed the production equipment which will be utilized to mass produce carriers such as carrier tube 34. The equipment illustrated in FIGS. 9–13 is tooling which was constructed solely for the purpose of manufacturing a few prototypes of the carrier tube 34, but it does serve to generally illustrate the manner in which the carrier tube 34 is manufactured.

Figure 9:
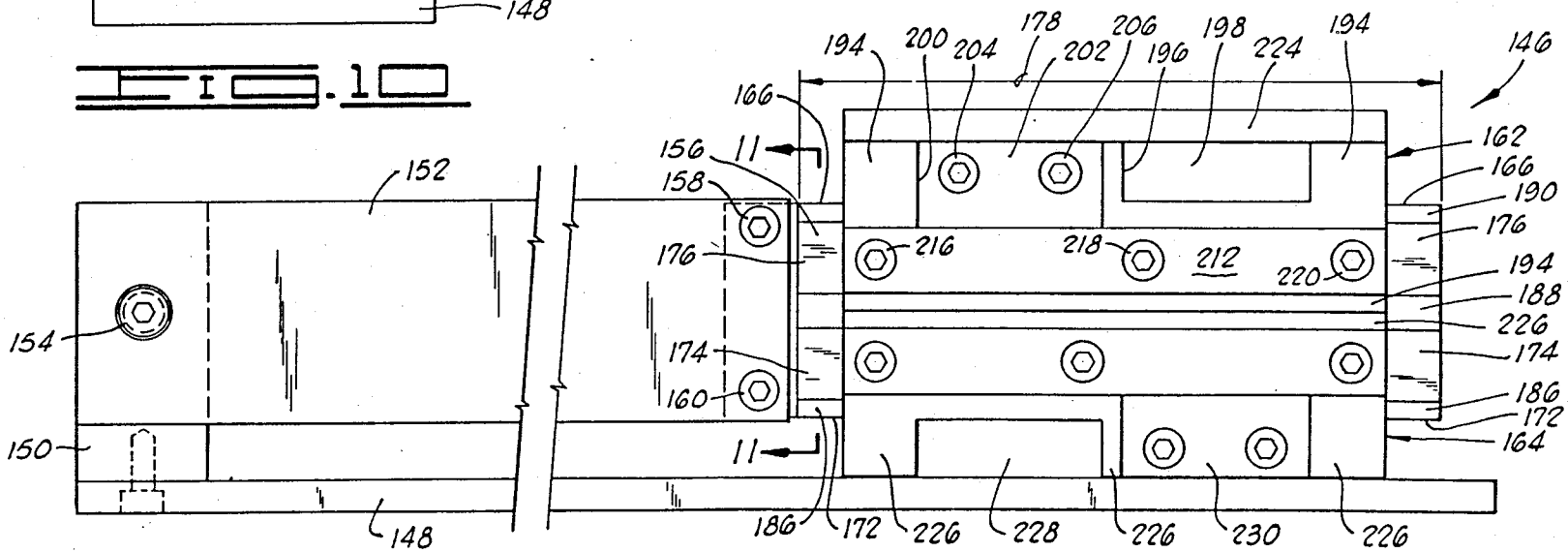
FIG. 9 is a side elevation view of a press forming apparatus for forming the flat areas on the carrier tube of FIG. 5.

FIG. 9 is a side elevation view of a press forming apparatus 146 which is utilized to form the flat areas 36 on the generally cylindrical carrier tube 34.

Apparatus 146 includes a base 148. At the left end of base 148 a support post 150 extends upward from base 148 and has an arm 152 pivotally connected thereto by pivot pin 154.

The arm 152 has an internal press mandrel 156 attached to the right end thereof by a pair of machine screws 158 and 160.

In FIG. 9 the internal press mandrel 156 is shown in place between an upper forming block assembly 162 and a lower forming block assembly 164. The internal press mandrel 156 can be generally referred to as an internal press tool 156. The upper and lower forming block assemblies 162 and 164 can be generally referred to as external press tools 162 and 164.

Figure 11:
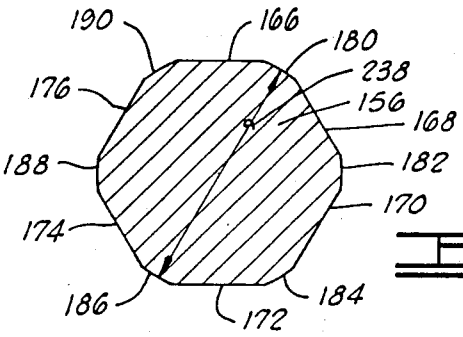
FIG. 11 is a cross-sectional view, taken along line 11—11 of FIG. 9, of an internal press mandrel of the apparatus of FIG. 9.

FIG. 11, which is a section view taken along line 11—11 of FIG. 9, shows a cross-sectional view of internal press mandrel 156.

As is apparent from FIGS. 9 and 11, the internal press mandrel 156 has a plurality of equally angularly spaced flat surfaces 166, 168, 170, 172, 174 and 176 defined on an exterior thereof. Each of the surfaces 166 through 176 extends along substantially an entire length 178 of internal press mandrel 156.

Furthermore, the flat areas 166 through 176 are separated by substantially arcuate surfaces 180, 182, 184, 186, 188 and 190.

The reason for requiring the width 128 of the flat areas 36 of carrier tube 34 to define an angle 130 of less than 60° is to allow the carrier tube 34 to slide on mandrel 156 during the forming operation. If the width 128 of flat areas 36 defined an angle of greater than 60° it would not be possible to form them on a mandrel like mandrel 156 and to then slide the carrier tube 34 relative to the mandrel.

Although the press mandrel 156 is illustrated as having six flat surfaces, it of course would be constructed differently if it were desired to form a different pattern of flat surfaces on the generally cylindrical carrier tube 34. For example, if it were desired to form the flat areas in sets of two flat areas, the internal press mandrel 156 would be formed with four flat surfaces, and if it were desired to construct a carrier tube wherein each set had four flat areas, the mandrel 156 could be constructed to have eight flat areas.

Generally, the internal press mandrel 156 may be described as having 2n flat surfaces spaced at angles of substantially (360/2n) degrees, where n is an integer greater than one. Also, the pattern portions such as pattern portion 96 can be described generally as having a plurality of flat areas arranged in two sets, such as 110 and 112, each having n flat areas, with the flat areas of each set being spaced at angles of substantially (360/n) degrees.

In FIG. 9, the internal press mandrel 156 is shown in position between the upper and lower forming block assemblies 162 and 164, without a carrier tube 34 in place therebetween.

It will be understood that FIG. 9 is shown this way merely for purposes of illustration, and that when the apparatus 146 is in use, a generally cylindrical carrier tube 34 will be concentrically placed about the internal press mandrel 156 as is further described below.

The upper and lower press assemblies 162 and 164 are designed to be pressed together about the outer surface of a cylindrical carrier tube 34 after the cylindrical carrier tube 34 is placed about the internal press mandrel 156, to form six flat areas of a given pattern portion such as pattern portion 94 (see FIG. 5) simultaneously.

Figure 10:
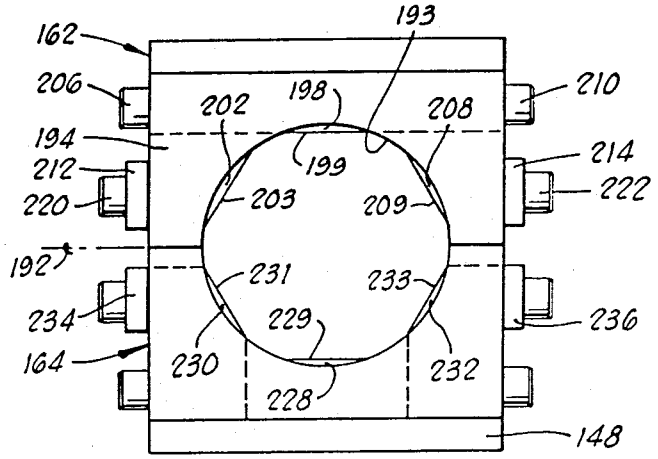
FIG. 10 is a right end elevation view of a portion of the apparatus of FIG. 9.

FIG. 10 is a right end elevation view of the upper and lower press block assemblies 162 and 64 without the internal press mandrel 156 in place therein.

As can be seen in FIG. 10, the upper and lower press block assemblies 162 and 164 freely engage each other along a horizonal center plane represented by the imaginary line 192. When the upper and lower forming block assemblies 162 and 164 are placed together, they define a cylindrical opening 193 therethrough within which the internal press mandrel 156 and a cylindrical carrier tube 34 are to be concentrically received. The internal diameter of cylindrical opening 193 is substantially the same as an outside diameter of the generally cylindrical carrier tube 34 with the addition of a very slight clearance.

The upper press block assembly 162 includes a main body member 194. Body member 194 has a first cavity 196 defined therein within which is received a first forming block 198, which as seen in FIG. 10 has a flat surface 199 protruding partially into the cylindrical opening 193.

A second cavity 200 is defined in main body member 194 of upper forming block assembly 162 and has a second forming block 202 received therein and attached thereto by machine screws such as 204 and 206. Second forming block 202 also has a flat surface 203 which protrudes partially into the opening 193 as seen in FIG. 10.

Similarly, on the back side of FIG. 9, a third forming block 208 is received in yet another cavity of main body member 194 of upper forming block assembly 162, and it also has a flat surface 209 which partially protrudes into opening 193 as shown in FIG. 10. Machine screws such as 210 attach the third forming block 208 to main body member 194.

Additionally, on each side of main body member 194, are holding straps 212 and 214 which are attached to main body member 194 by machine screws 216, 218, 220, 222 and a couple of others which are not visible, to aid in holding the second and third forming blocks 202 and 208 in place relative to main body member 194.

Upper forming block assembly 162 also includes a top cover plate 224 which is attached to main body member 194 by a plurality of coutersunk machine screws (not shown) extending vertically downward therethrough and into the main body member 194. The top cover plate 224 and its associated countersunk machine screws hold the first forming block 198 in place relative to main body member 194.

The lower forming block assembly 164 is similarly constructed, with the base 148 taking the place of top cover plate 124.

Lower forming block assembly 164 includes a main body member 226 having fourth, fifth and sixth forming blocks 228, 230 and 232 along with holding straps 234 and 236 and a number of machine screws similar to those previously described. The forming blocks 228, 230 and 232 have flat surfaces 229, 231 and 233, respectively, protruding into the opening 193.

The upper and lower forming block assemblies 162 and 164, and the internal press mandrel 156 are dimensioned so that a generally cylindrical carrier tube 34 can be received therebetween, and will have six flat areas 36 formed thereon when the upper and lower press block assemblies 162 and 164 are pressed together about the carrier tube 34.

Each of the arcuate surfaces 180 through 190 seen in FIG. 11 define portions of a circle having a diameter 238 which is slightly less than an internal diameter 240 of carrier tube 34 (see FIG. 7). Similarly, the internal diameter of cylindrical opening 193 seen in FIG. 10 is slightly greater than an outer diameter 242 (see FIG. 7) of carrier tube 34.

Thus, the radius of curvature of the arcuate portions 180 through 190 of internal press mandrel 156 is slightly less than the radius of cylindrical opening 193 seen in FIG. 10.

Similarly, the upper and lower press blocks 162 and 164 and the internal press mandrel 156 are constructed to provide a clearance between the flat surfaces 166 through 176 and the associated flat surfaces 199, 209, 233, 229, 231 and 203 of forming blocks 198, 208, 232, 228, 230 and 202, respectively, slightly greater than a wall thickness of the carrier tube 34.

To form the flat areas 36 on the carrier tube 34, a portion of the carrier tube 34 is placed over the internal press mandrel 156, and then the upper and lower press block assemblies 162 and 164 are squeezed together by a conventional hydraulic press so as to engage at imaginary line 192 as shown in FIG. 10. This presses six flat areas 36 on the portion of carrier tube 34 which is received within the upper and lower press block assemblies 162 and 164.

For example, referring to FIG. 5, a portion of the carrier tube 34 such as that between imaginary lines 102 and 100 would be placed about the internal press mandrel 156 and then pressed between the upper and lower press block assemblies 162 and 164 to form the six flat areas 36 previously designated as second pattern portion 96. All six of the flat areas 36 of second pattern portion 196 would be formed substantially simultaneously.

Then, the upper and lower press block assemblies 162 and 164 are disengaged, and the carrier tube 34 is longitudinally indexed relative to internal press mandrel 156 so that the portion of carrier tube lying between imaginary lines 100 and 98 is now in a position to be pressed. Thus, the carrier tube 34 has been indexed by a distance 244 (see FIG. 5) equal to the length of pattern segment 96 between imaginary lines 100 and 102.

Then, the upper and lower press block assemblies 162 and 164 are again pressed together to form the six flat areas previously described as the first pattern portion 94 in FIG. 5.

This process of indexing and pressing is repeated until the entire length of carrier tube 34 has the flat areas 36 formed thereon in the pattern such as illustrated in FIG. 5.

Figures 12, 13, 14:
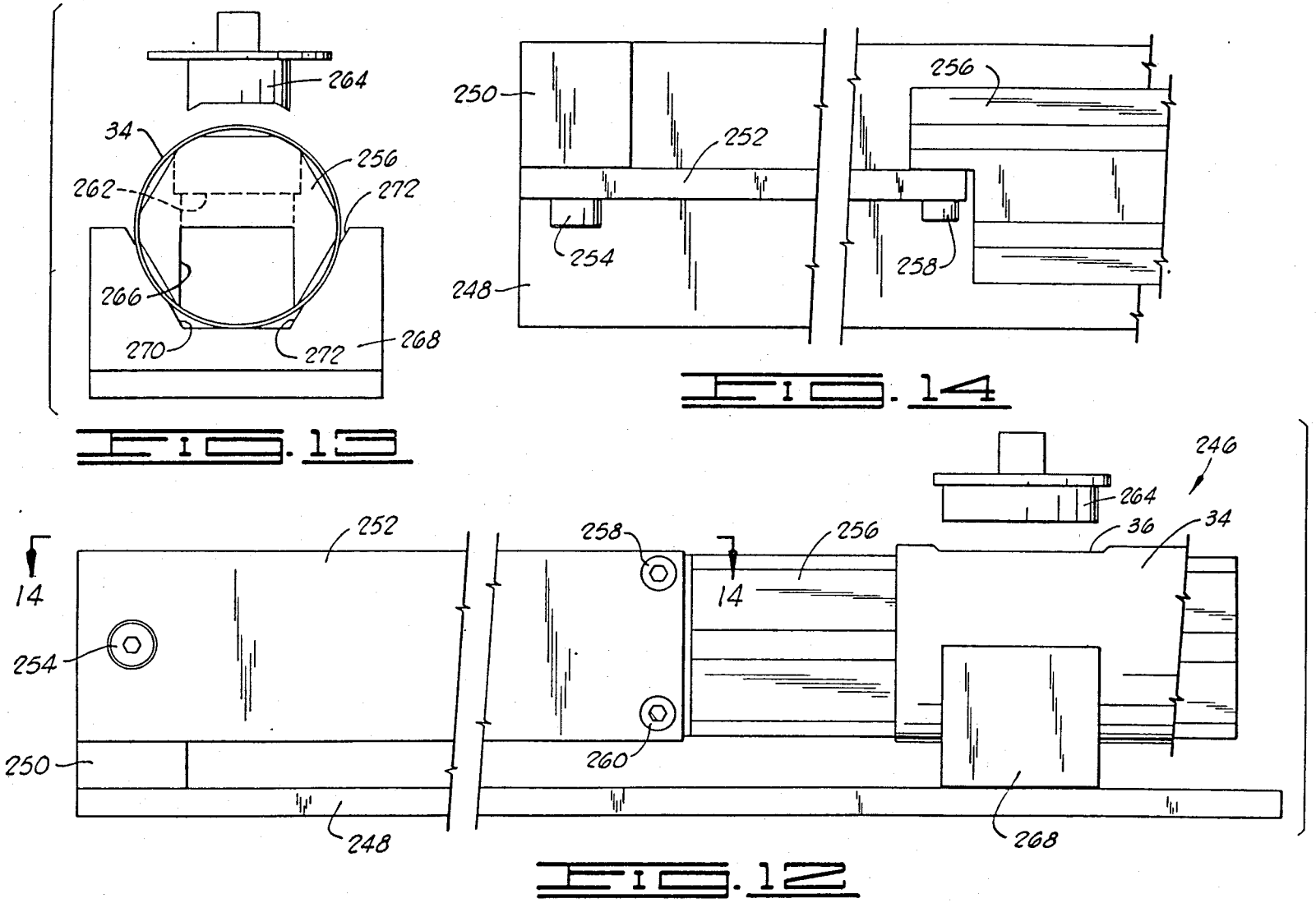
FIG. 12 is a side elevation view of a hole forming apparatus for forming the openings in the flat areas of the carrier tube of FIG. 5.
FIG. 13 is a right end elevation view of the apparatus of FIG. 12.
FIG. 14 is a top plan view of the left end of the apparatus of FIG. 12 taken along line 14—14 of FIG. 12.

After the entire length of carrier tube 34 has had the flat areas 36 formed thereon, the openings 38 are formed therein with the apparatus illustrated in FIGS. 12–14.

FIG. 12 is a side elevation view of a hole forming apparatus 246.

Hole forming apparatus 246 includes a base 248 having a post 250 extending upward therefrom. An arm 252 is pivotally attached to post 250 by pivot pin 254.

A die holder mandrel 256 is attached to arm 252 by machine screws 258 and 260.

FIG. 14 shows a plan view of the left end of the apparatus 246 which further illustrates the manner in which die holder mandrel 256 is attached to the arm 252. The illustration is FIG. 14 is also applicable to the manner of attachment of internal press mandrel 156 to arm 152 of FIG. 9.

The die holder mandrel 256 is in some details similar to internal press mandrel 156. A cross-sectional view of die holder mandrel 256 taken near its left end would appear substantially the same as FIG. 11. The rightmost portion of die holder mandrel 256 illustrated in FIG. 12 is constructed differently than internal press mandrel 156, as is best appreciated by viewing FIG. 13.

In the upper portion of die holder mandrel 256 a die 262 is located as indicated in dashed lines in FIG. 13. The die 262 has an opening therein having a shape substantially the same as that of opening 38 having slots such as 138 and 140 extending upward and downward therefrom as illustrated in FIG. 5.

A punch 264 is associated with die 262, and the punch 264 also has a shape substantially the same as that of opening 38 with slots 138 and 140 as seen in FIG. 5.

The punch 264 is illustrated in FIGS. 12 and 13 as being located above the die 262.

It will be understood by those skilled in the art that the apparatus 246 and the punch 264 will each be placed within a conventional hydraulic press or the like which provides the power to force the punch 264 vertically downward through the wall of cylindrical carrier tube 34 and into the die 262 to cut the opening 38 and the slots such as 138 and 140 (see FIG. 5) into each of the flat areas 36 to form the opening 38 and the resilient tab means 58.

The plugs cut from the wall of the carrier tube 34 are then allowed to fall into an open cavity 266 in the die holder mandrel 256 below die 262 so that they can be removed.

The apparatus 246 includes a cradle block 268 which has first and second sloped inner surfaces 270 and 272 defined therein for cradling two of the flat areas 36 of carrier tube 34 while the opening 38 is being formed in a third flat area of a set of three flat areas.

For example, FIG. 12 illustrates a portion of the carrier tube 34 in place about the die holder mandrel 256.

It will be understood that all of the flat areas 36 have already been formed on the carrier tube 34 before it is placed on the apparatus of FIG. 12, and those flat areas will engage the six flat surfaces of die holder mandrel 256 as illustrated in FIG. 13.

Assuming for purposes of illustration that FIG. 12 represents the position of carrier tube 34 when the openings 36 are being punched in the set 112 (see FIG. 5) of flat areas 36, two of the three flat areas 36 of set 112 are engaged with the surfaces 270 and 272, and the third flat area is located between the die 262 and the punch 264.

The punch 264 is then moved downward to cut the opening 36 and the slots adjacent the tabs of tab means 58 into the flat area 36 seen in FIG. 12 immediately below die 264.

To cut the openings in the other flat areas of set 112, the carrier tube 34 must be removed from the die holder mandrel 256, then rotated through an angle of 120°, then placed back on the die holder mandrel 256.

The method of manufacturing the carrier tube 34 can generally be described as follows. First, a generally cylindrical thin wall carrier tube 34 must be provided. Then, a plurality of flat areas 36 are formed on the carrier tube 34 as described with regard to the apparatus of FIGS. 9–11.

Then, openings 38 are formed through each of the flat areas.

Referring, for example, to the flat areas 36 of pattern portion 96 seen in FIG. 5, it will be apparent that the flat areas of set 112 thereof will be formed against different ones of the flat surfaces 166 through 176 of internal press mandrel 156 than are the flat areas of the other set 110 of pattern portion 96. For example, the flat areas 36 of set 112 might be formed against flat surfaces 166, 170 and 174, while the flat areas 36 of set 110 are simultaneously formed against the flat surfaces 168, 172 and 176.

Although the embodiment illustrated in the present application has the flat areas 36 arranged in sets of several flat areas located at a common longitudinal distance from the ends of the carrier tube 34, the invention in its broader aspects contemplates many other possible arrangements. For example, a single flat area could be provided at each longitudinal level, or the flat areas could be arranged in a spiral pattern.

Thus, it is seen that the apparatus of the present invention readily achieves the ends and advantages mentioned as well as those inherent therein. Numerous changes in the arrangement and construction of parts may be made by those skilled in the art, which changes are encompassed within the scope and spirit of the present invention as defined by the appended claims.

What is claimed is:

1. A method of manufacturing a tubular shaped charge carrier, comprising the steps of:

(a) providing a generally cylindrical thin wall carrier tube; and (b) substantially simultaneously forming a plurality of flat areas on said carrier tube in a first pattern portion of a plurality of substantially identical pattern portions comprising a pattern.

2. The method of claim 1, wherein:

said step (b) is further characterized in that said flat areas of each of said pattern portions are arranged in at least two sets, each of said sets including at least two flat areas located at a common longitudinal distance from an end of said carrier tube.

3. The method of claim 2, wherein:

each of said flat areas is formed by pressing a wall of said carrier tube between a first flat surface of an external press tool engaging an exterior surface of said carrier tube and a second flat surface of an internal press tool engaging an interior surface of said carrier tube.

4. The method of claim 3, wherein:

after all of said flat areas of said given one of said pattern portions are formed, said carrier tube is longitudinally indexed relative to said external and internal press tools by a distance equal to a length of each of said pattern portions; and then all of said flat areas of an adjacent one of said pattern portions are formed substantially simultaneously.

5. The method of claim 1 including the further step of:

(c) forming an opening through each of said flat areas using a punch and die having a configuration corresponding to a shape of said opening.

6. The method of claim 5, wherein:

said step (b) is further characterized in that each of said openings is formed through its associated flat area after its associated flat area is formed; and simultaneous with the forming of each one of said openings, a resilient tab means is formed by said punch and die in the flat area associated with each of said openings, each of said tab means being characterized as extending into the opening associated with its associated flat area for frictionally engaging the shaped charge to be received therein to thereby hold said shaped charge in place relative to said carrier tube.

7. The method of claim 6, wherein:

said forming of each of said tab means is further characterized in that each of said resilient tab means includes two diametrically opposed tabs located on opposite sides of their associated opening, said tabs extending into said opening toward each other, and said tabs being aligned substantially parallel to a longitudinal axis of said carrier tube.

8. A method of manufacturing a shaped charge carrier for a perforating gun, said method comprising the steps of:

(a) providing an internal press mandrel having a plurality of equally angularly spaced flat surfaces defined on an exterior thereof, each of said flat surfaces extending along substantially an entire length of said mandrel;

(b) placing a first portion of a generally cylindrical carrier tube substantially concentrically about said mandrel;

(c) engaging an outer surface of said first portion of said carrier tube with an external press means and thereby substantially simultaneously forming a first plurality of flat areas on said carrier tube, said first plurality of flat areas being formed against at least some of said flat surfaces of said mandrel;

(d) then indexing said carrier tube longitudinally relative to said mandrel by a distance substantially equal to a length of said first portion of said carrier tube;

(e) then engaging an outer surface of a second portion of said carrier tube with said external press means and thereby substantially simultaneously forming a second plurality of flat areas on said carrier tube; and (f) forming an opening associated with each of said flat areas for receiving a shaped charge therein.

9. The method of claim 8, wherein said step (c) is further characterized in that:

said first plurality of flat areas of said first portion of said carrier tube are arranged in at least two longitudinally spaced sets, each of said sets including at least two flat areas; and said flat areas of one of said sets are formed against different ones of said flat surfaces of said mandrel than are said flat areas of another one of said sets.

10. The method of claim 9, wherein:

said step (a) is further characterized in that said mandrel has 2n of said flat surfaces spaced at angles of substantially (360/2n) degrees where n is an integer greater than one;

said step (c) is further characterized in that said first plurality of flat areas are arranged in two sets of n flat areas each, said flat areas of each set being spaced at angles of substantially (360/n) degrees.

11. The method of claim 10, wherein:

said step (a) is further characterized in that in a cross section normal to a longitudinal axis of said mandrel, each of said flat surfaces defines an angle about said longitudinal axis less than (360/2n) degrees and said flat surfaces are separated by substantially arcuate surfaces, said arcuate surfaces having a radius of curvature slightly less than a radius of an internal cylindrical surface of said carrier tube.

12. The method of claim 11, wherein:

said step (a) is further characterized in that n equals three.

13. The method of claim 10, wherein:

said step (a) is further characterized in that n equals three.

14. The method of claim 8, wherein:

said step (f) is further characterized in that each of said openings is formed through its associated flat area after its associated flat area is formed.

15. The method of claim 14, wherein:

said step (f) is further characterized in that said openings are formed one at a time.

16. The method of claim 15, wherein:

simultaneous with the forming of each one of said openings, a resilient tab means is formed in the flat area associated with each of said openings, each of said tab means being characterized as extending into the opening associated with its associated flat area for frictionally engaging the shaped charge to be received therein to thereby hold said shaped charge in place relative to said carrier tube.

17. The method of claim 16, wherein:

said forming of each of said tab means is further characterized in that each of said resilient tab means includes two diametrically opposed tabs located on opposite sides of their associated opening, said tabs extending into said opening toward each other, and said tabs being aligned substantially parallel to a longitudinal axis of said carrier tube.

* * * * *